US008646709B2

(12) United States Patent
Ramun et al.

(10) Patent No.: US 8,646,709 B2
(45) Date of Patent: Feb. 11, 2014

(54) JAW SET WITH SERRATED CUTTING BLADES

(75) Inventors: Michael Richard Ramun, Mineral Ridge, OH (US); John R. Ramun, Poland, OH (US)

(73) Assignee: John R. Ramun, Poland, OH (US)

( * ) Notice: Subject to any disclaimer, the term of this patent is extended or adjusted under 35 U.S.C. 154(b) by 8 days.

(21) Appl. No.: 13/444,211

(22) Filed: Apr. 11, 2012

(65) Prior Publication Data

US 2013/0270379 A1 Oct. 17, 2013

(51) Int. Cl.
*A01D 34/00* (2006.01)
*B02C 9/04* (2006.01)

(52) U.S. Cl.
USPC ..... 241/101.73; 241/266

(58) Field of Classification Search
USPC ..... 241/101.73, 266
See application file for complete search history.

(56) References Cited

U.S. PATENT DOCUMENTS

| | | | | |
|---|---|---|---|---|
| 4,519,135 | A | 5/1985 | LaBounty | |
| 4,670,983 | A | 6/1987 | Ramun et al. | |
| 4,838,493 | A | 6/1989 | LaBounty | |
| 4,951,886 | A | 8/1990 | Berto | |
| 5,044,569 | A | 9/1991 | LaBounty et al. | |
| 5,060,378 | A | 10/1991 | LaBounty et al. | |
| 5,301,882 | A | 4/1994 | Morikawa et al. | |
| 5,361,999 | A | 11/1994 | Sakato et al. | |
| 5,474,242 | A | 12/1995 | Rafn | |
| RE35,432 | E | 1/1997 | LaBounty et al. | |
| 5,822,893 | A | 10/1998 | Ostermeyer | |
| 5,926,958 | A | 7/1999 | Ramun | |
| 5,940,971 | A | 8/1999 | Ramun | |
| 6,061,911 | A | 5/2000 | LaBounty et al. | |
| 6,202,308 | B1 | 3/2001 | Ramun | |
| 6,766,973 | B2 * | 7/2004 | Muri | 241/101.73 |
| 6,839,969 | B2 * | 1/2005 | Jacobson et al. | 30/134 |
| 6,926,217 | B1 | 8/2005 | LaBounty et al. | |
| 7,121,489 | B2 * | 10/2006 | Ramun | 241/266 |
| 7,284,718 | B2 * | 10/2007 | Christenson | 241/101.73 |
| 7,354,010 | B2 * | 4/2008 | Ramun et al. | 241/101.73 |
| 7,578,461 | B2 * | 8/2009 | Sederberg et al. | 241/101.73 |
| 7,971,816 | B2 * | 7/2011 | Andrina | 241/101.73 |
| 2003/0132327 | A1 | 7/2003 | Muri | |
| 2006/0131454 | A1 | 6/2006 | Ramun et al. | |
| 2007/0001041 | A1 | 1/2007 | Christenson | |
| 2007/0006439 | A1 * | 1/2007 | Ramun | 29/407.02 |
| 2007/0245568 | A1 | 10/2007 | Schipp et al. | |
| 2008/0263870 | A2 * | 10/2008 | Johnson et al. | 30/134 |
| 2011/0031338 | A1 * | 2/2011 | Ramun et al. | 241/30 |
| 2011/0068205 | A1 * | 3/2011 | Ramun | 241/266 |

FOREIGN PATENT DOCUMENTS

| | | | |
|---|---|---|---|
| DE | 4417832 | A1 | 11/1994 |
| EP | 0384872 | A1 | 8/1990 |
| JP | 58128258 | U | 8/1983 |
| JP | 63111550 | U | 7/1988 |

(Continued)

*Primary Examiner* — Dana Ross
*Assistant Examiner* — Onekki Jolly
(74) *Attorney, Agent, or Firm* — The Webb Law Firm

(57) ABSTRACT

A jaw set utilizes blade inserts having serrated surfaces which draw in to capture and cut material prior to the material becoming trapped in the apex of the blade arrangement, thereby maximizing efficiency of the cutting operation. The subject invention is also directed to an individual blade insert having grooves that are longitudinally offset from bolt holes used to retain the blade insert within a jaw set.

15 Claims, 8 Drawing Sheets

(56) References Cited

FOREIGN PATENT DOCUMENTS

| | | | |
|---|---|---|---|
| JP | 4183516 | A | 6/1992 |
| JP | 2001327882 | A | 11/2001 |
| JP | 2004176536 | A | 6/2004 |
| WO | 0128687 | A1 | 4/2001 |
| WO | 0168992 | A1 | 9/2001 |
| WO | 2004044349 | A2 | 5/2004 |

* cited by examiner

JAW SET WITH SERRATED CUTTING BLADES

BACKGROUND OF THE INVENTION

1. Field of the Invention

The present invention relates to a jaw set used in demolition and recycling equipment. More particularly, the present invention relates to a jaw set having serrated blade inserts to provide for efficient cutting of wire cable, small diameter pipe, and the like.

2. Description of Related Art

While the present invention relates to demolition and recycling equipment, this equipment is also referred to as construction equipment and scrap handling/processing equipment. The description of demolition equipment, recycling equipment, scrap handling equipment, or construction equipment is not intended to be restrictive to the equipment being referenced.

In the dismantling of an industrial site, wire cable and small diameter pipes are often encountered. FIG. 1 is prior art and illustrates a shear attachment 10 having a jaw set 20 made up of a first jaw 25 and a second jaw 30 which rotates relative to the first jaw 25 about a rotational axis RA. A first jaw blade 40 extends from a front end 45 of the first jaw 25 to a back end 50 of the first jaw 25 proximal to the rotational axis RA. The first jaw blade 40 has a front section 55 and a rear section 60 forming an obtuse angle A relative to the front section 55 defining an apex 65 therebetween.

A second jaw blade 70 extends from a front end 75 of the second jaw 30 to a back end 80 of the second jaw 30 proximate to the rotational axis RA.

The first jaw blade 40 and the second jaw blade 70 have mounted therein blade inserts having smooth surfaces as illustrated in FIG. 1.

While this configuration is capable of cutting small diameter pipe P and, additionally, wire cable, as illustrated for pipe in FIG. 2, the manner by which it does so is not efficient and results in premature wear. In particular, as the first jaw 25 and the second jaw 30 come together, the pipe P is moved along the first jaw blade 40 and the second jaw blade 70 until the pipe P contacts the apex 65, at which time the cutting proceeds. This occurs because, as the first jaw 25 and the second jaw 30 come together, there exists between the front section 55 of the first jaw 25 and the section 70 of the second jaw 30 an acute angle B. More particularly, the acute angle B is measured from the cutting surface 42 of the first jaw blade 40 and the cutting surface 72 of the second jaw blade 70. While this may be an effective means of cutting the pipe because the small diameter pipe P always migrates to the apex 65, since the first jaw blade 40 and the second jaw blade 70, in the region of the apex, are the only regions used to cut the pipe then, over time, this small segment adjacent to the apex 65 of the first jaw blade 40 and the opposing portion of the second jaw blade 70 experience excessive wear relative the remaining portions of the first jaw blade 40 and the second jaw blade 70.

A design is needed to provide for more efficient cutting of small diameter pipes and wire cable by utilizing a greater portion of the first jaw blade and the second jaw blade.

SUMMARY OF THE INVENTION

The subject invention is directed to a jaw set for demolition equipment, wherein the jaw set is made up of a first jaw and a second jaw and, wherein at least one jaw rotates relative to the other jaw about a rotational axis. The jaw set comprises a first jaw blade extending from a front end of the first jaw to a back end of the first jaw proximate to the rotational axis, wherein the first jaw blade has a front section and a rear section forming an obtuse angle relative to the front section defining an apex therebetween. At least one blade insert is secured to each of the front section and the rear section of the first blade, wherein each blade insert has a longitudinal axis extending along the length of each insert. At least one blade insert of the front section has a cutting surface with grooves spaced along the longitudinal axis to provide a serrated cutting surface. A second jaw blade extends from a front end of the second jaw to a back end of the second jaw proximate to the rotational axis. At least one blade insert is secured to a section of the second blade, wherein each blade insert has a longitudinal axis extending along the length of each insert. At least one blade insert of the section has a cutting surface with grooves spaced along the longitudinal axis to provide a serrated cutting surface. In a closed position, the cutting surface of the blade insert of the front section of the first jaw forms an acute angle with the cutting surface of the blade insert of the section of the second jaw blade.

In a second embodiment of the subject invention, a blade insert for use with jaws for demolition equipment has a generally rectangular body with a longitudinal axis extending thereon and a width extending thereacross. Each blade is comprised of a top side having a cutting surface. The cutting surface has grooves extending thereacross with planar surfaces therebetween. Bolt holes extend through the width of the blade and are positioned along the longitudinal axis at a location spaced from that of the grooves to provide maximum strength to the blade.

DESCRIPTION OF THE PREFERRED EMBODIMENTS

The inventors have discovered that by changing the configuration of the blade inserts in the jaw set, it is possible to cause the cutting of a small diameter pipe or a wire cable to occur at different locations along the first jaw blade and the second jaw blade and to minimize or prevent the cutting of such items at the apex location. By utilizing different areas of the first jaw blade and the second jaw blade for cutting, not only is the blade wear at the apex minimized or eliminated, but, furthermore, by distributing the cutting along different parts of the jaw blades, the life of the blade inserts may be significantly extended while, at the same time, maintaining a high quality cut. The modification of the subject invention relative to the prior art is the substitution of one or more blade inserts within the jaw blades to provide serrated blade inserts as opposed to smooth blade inserts. In particular, the inventors have discovered that by providing serrated blade inserts within the first jaw blade and the second jaw blade, the small diameter pipe or the wire cable is essentially grabbed and not permitted to slide along the jaw blade to the apex. Additionally, such a configuration may be more effective in cutting larger structural steel because the serrated blade inserts cause the steel to yield before the part is cut, thereby reducing the force needed to sever the part.

Figure 3:
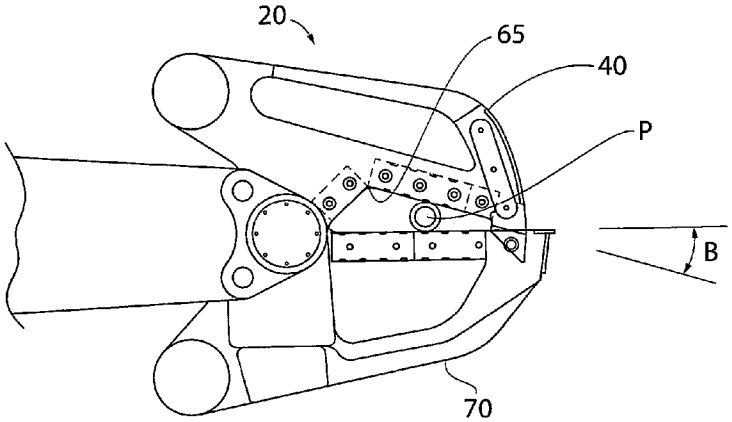
FIG. 3 shows a jaw set in accordance with the subject invention cutting a small diameter of pipe.
Figure 4:
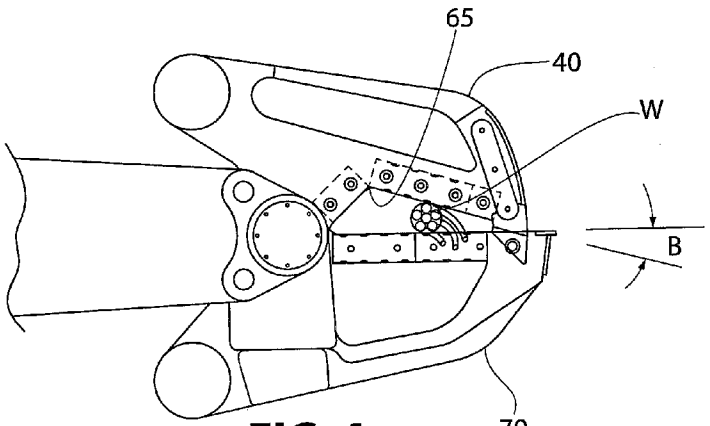
FIG. 4 shows the jaw set of subject invention cutting wire cable.

Directing attention to FIG. 3, blade inserts with such serrations are illustrated in the first jaw blade 40 and second jaw blade 70. In FIG. 3, the small diameter pipe P is retained by the serrations and restrained from sliding within the jaw set 20 back to the apex 65. In a similar manner, directing attention to FIG. 4, wire cable W is shown between the first jaw blade 40 and the second jaw blade 70 and, once again, is retained and not permitted to slide back to the apex. It can be appreciated that, by utilizing this design, either the small diameter pipe P or the wire cable W may be retained within the jaw set 20 where the initial contact between the pipe P or the wire cable W with the first jaw blade 40 and the second jaw blade 70 initially occurred. This design provides not only a cleaner cut for small diameter pipes but, furthermore, with respect to wire cable W, the relative motion of the first jaw blade 40 and the second jaw blade 70 tends to roll the wire cable W such that, not only is the wire cable W cut, but, during the process, the wire cable W is also unwound, thereby further reducing the cutting forces needed by the jaw set 20 to effectively cut the wire cable W.

Figure 5:
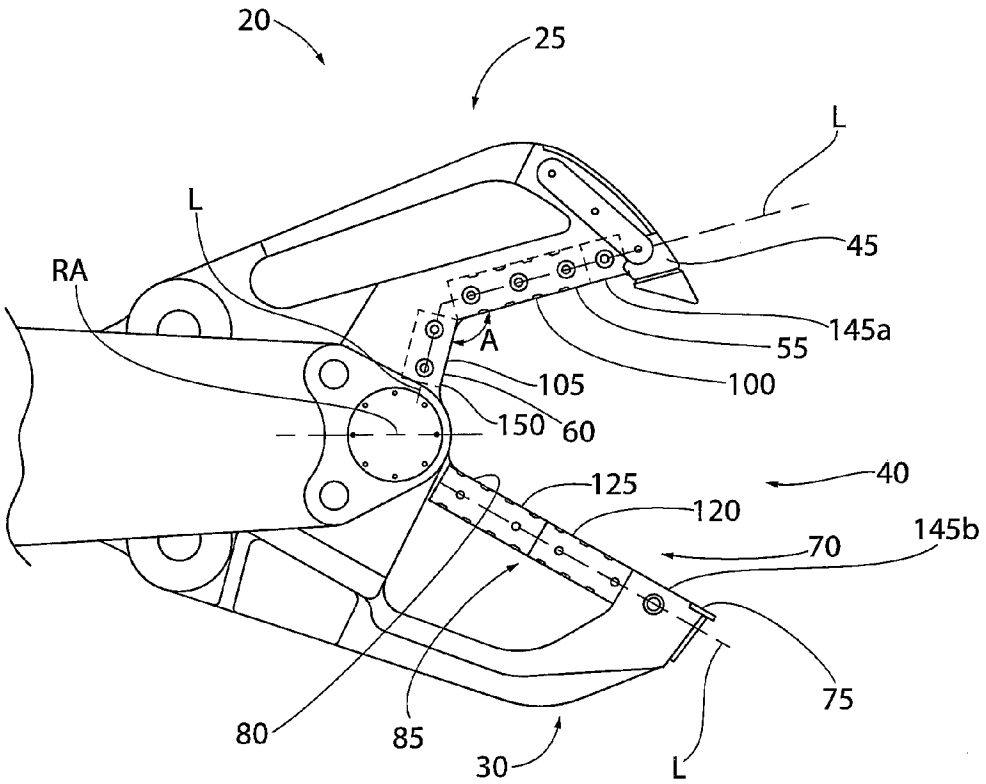
FIG. 5 is a side view of a jaw set in accordance with the subject invention.

Directing attention to FIG. 5, the jaw set 20 is made up of a first jaw 25 and a second jaw 30, wherein at least one jaw rotates relative to the other jaw about a rotational axis RA.

The jaw set 20 is made up of a first jaw blade 40 extending from a front end 45 of the first jaw 25 to a back end 50 proximate to the rotational axis RA. The first jaw blade 40 has a front section 55 and a rear section 60 forming an obtuse angle A relative to the front section 55 defining an apex 65 therebetween.

At least one blade insert 100 is secured to the front section 55 of the first jaw blade 40 and at least one blade insert 105 is secured to the rear section 60 of the first jaw blade 40. Each blade insert has a longitudinal axis L extending along the length of that insert.

Figure 6C:
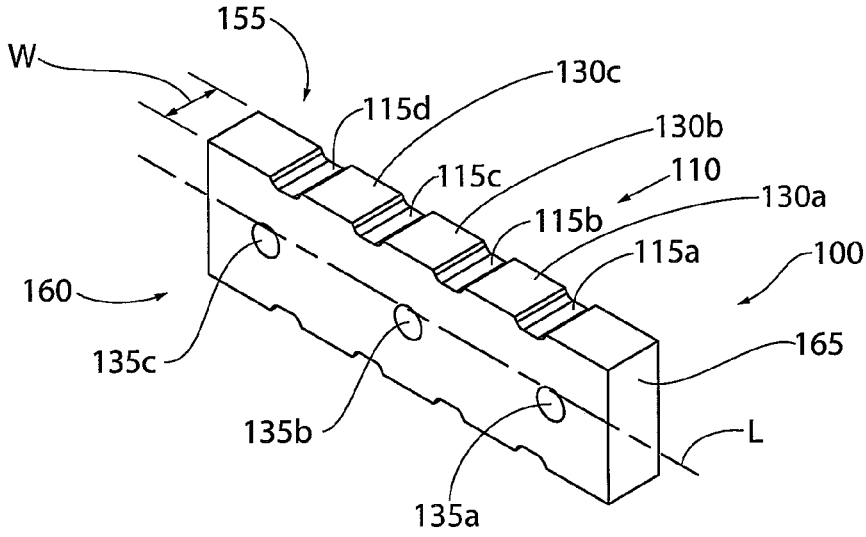
FIG. 6C is a perspective view of the blade insert illustrated in FIG. 6A.
Figure 6B:
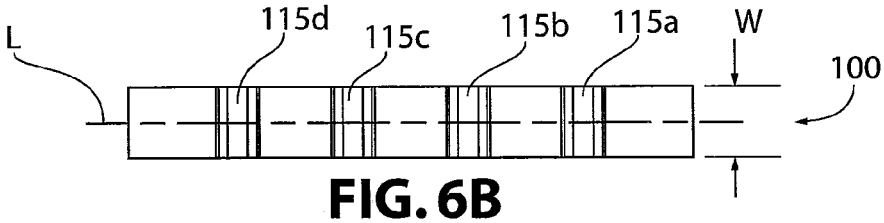
FIG. 6B is a top view of the blade insert of FIG. 6A.
Figure 6A:
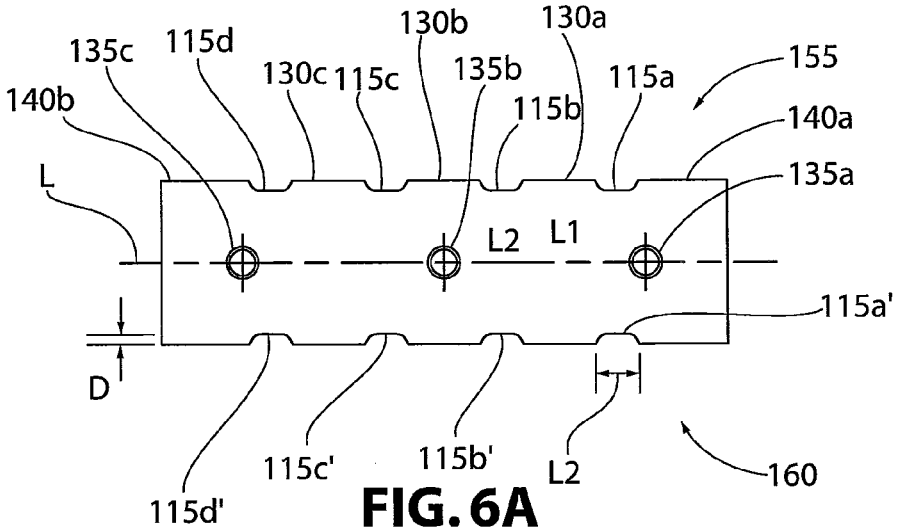
FIG. 6A is a side view of a blade insert in accordance with the subject invention.

Directing attention to FIGS. 6A-6C, at least one blade insert 100 of the front section 55 has a cutting surface 110 with grooves 115*a*, 115*b*, 115*c*, 115*d* spaced along the longitudinal axis L to provide a serrated cutting surface.

Returning to FIG. 5, a second jaw blade 70 extends from a front end 75 of the second jaw 30 to a back end 80 of the second jaw 30 proximate to the rotational axis RA. At least one blade insert 120 is secured to a section 85 of the second jaw blade 70, wherein the blade insert 120 has a longitudinal axis L extending along the length of the insert 120. From inspection of FIG. 5, it should be pointed out that the second jaw blade 70 has associated with it a second blade insert 125 similar to blade insert 120.

The blade inserts 120, 125 have similar features as those associated with blade insert 100 and, as a result, the blade insert 100, previously discussed with respect to FIGS. 6A-6C, also describes the blade inserts 120, 125 associated with the second jaw blade 70.

Directing attention again to FIGS. 6A-6C, planar segments 130*a*, 130*b*, 130*c* are interspersed between the grooves 115*a*, 115*b*, 115*c*, 115*d*.

Of particular importance with respect to the subject invention, FIG. 6A illustrates the blade insert 100 having bolt holes 135*a*, 135*b*, 135*c* extending therethrough perpendicular to and along the length of the longitudinal axis L and parallel to the planar segments 130*a*, 130*b*, 130*c*. The bolt holes 135*a*, 135*b*, 135*c* are longitudinally spaced from each groove 115*a*, 115*b*, 115*c*, 115*d* to provide maximum blade strength. In contrast, if a bolt hole 135*a* is aligned with, for example, a groove 115*a*, then the cross-sectional area of the material of the blade insert 100 has diminished structural integrity.

As illustrated in FIGS. 6B and 6C, the grooves 115*a*, 115*b*, 115*c*, 115*d* are oriented perpendicular to the longitudinal axis L.

As further illustrated in FIG. 6B, blade insert 100 has a width W and the grooves 115*a*, 115*b*, 115*c*, 115*d* extend across the width W of the blade 100. Additionally, directing attention to FIG. 6A, the length L1 of planar segment 130*a* is greater than or equal to the length L2 of the adjacent groove 115*b*. This relationship applies to all of the planar segments 130*a*, 130*b*, 130*c*, with respect to the grooves 115*a*, 115*b*, 115*c*, 115*d*. It should be noted that the end planar sections 140*a*, 140*b* may not retain this relationship. However, in the event blade insert 100 is placed adjacent to another blade insert, then, the combined length of the end planar section 140*a* and, for example, end planar section 140*b* of another insert will maintain this same relationship, wherein their combined length is greater than or equal to the length of an adjacent groove, such as groove 115*a*.

Directing attention to FIG. 5, it may be preferred to provide smooth blade inserts 145*a*, 145*b* without grooves at the front end 45 of the first jaw blade 40 and at the front end 75 of the second jaw blade 70 for the purposes of allowing the work piece, such as the small diameter pipe P or the wire cable W, to move further within the jaw set 20 to increase the mechanical advantage of the cutting action. The blade insert 150 positioned between the apex 65 and the rear section 60 of the first jaw blade 40 may also have a smooth surface without grooves to urge any workpiece toward the opposite side of the apex 65.

Directing attention to FIG. 6A, in one embodiment, the groove 115*a*', for example, has a depth of ¼ inch and a length L2 of ½ inch. It should be noted that the geometry of the grooves is preferentially uniform within each blade insert 100 and, for that reason, the discussion of groove 115*a*' may be applicable to the other grooves in the blade insert 100. Additionally, from FIG. 6A, it should be appreciated that the grooves 115*a*, 115*b*, 115*c*, 115*d* on the top side 155 of the blade insert 100 are duplicated and indicated as 115*a*', 115*b*', 115*c*', 115*d*' on the bottom side 160 of the blade insert 100. By doing so, each blade insert 100 may be indexable, such that when the cutting edge on one side begins to wear, the blade insert 100 may be flipped to provide a fresh cutting edge.

As a general guideline, the groove length L2 may be at least twice the depth of the groove depth D.

As illustrated again in FIG. 6A, the grooves 115*a*, for example, may be generally U-shaped and radiused at the corners of the base to minimize stress concentration factors. However, the intersection of the grooves 115*a*, for example, with the planar segments 130*a*, for example, may have a sharp corner to promote cutting.

While it was previously mentioned that the bolt holes 135*a*, 135*b*, 135*c* are intentionally positioned away from the grooves 115*a*, 115*b*, 115*c*, 115*d*, it should be appreciated that the length of the planar sections 130*a*, for example, may vary to permit the bolt holes 135*a*, 135*b*, 135*c* to be offset from the grooves 115*a*, 115*b*, 115*c*, 115*d*.

The invention is also directed to a blade insert 100 for use with jaws for demolition equipment, wherein the blade insert 100, as illustrated in FIG. 6C, has a generally rectangular body 165 with longitudinal axis L extending thereon and a width W extending thereacross. The blade insert 100 is comprised of a top side 155 having a cutting surface 110 with grooves 115*a*, 115*b*, 115*c*, 115*d* extending thereacross and with planar surfaces 130*a*, 130*b*, 130*c* therebetween. Bolt holes 135*a*, 135*b*, 135*c* extend through the width W of the blade insert 100 and are positioned along the longitudinal axis L at a location spaced from that of the grooves 115*a*, 115*b*, 115*c*, 115*d* to provide maximum structural integrity of the blade.

Figure 1:
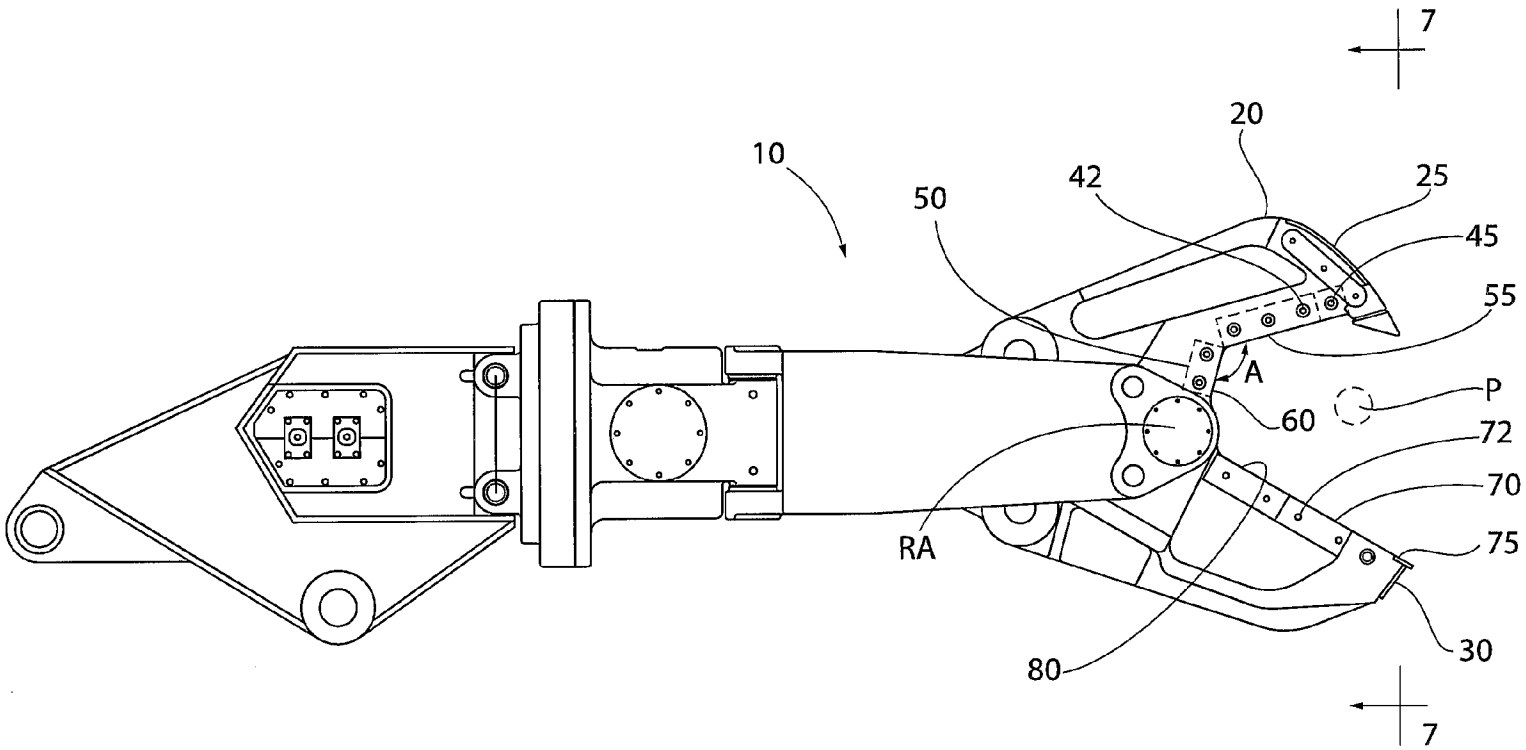
PRIOR ART FIG. 1
FIG. 1 is prior art of a shear attachment used with demolition equipment illustrating a first jaw blade and a second jaw blade having blade inserts with smooth edges with the jaws in the open position.
Figure 2:
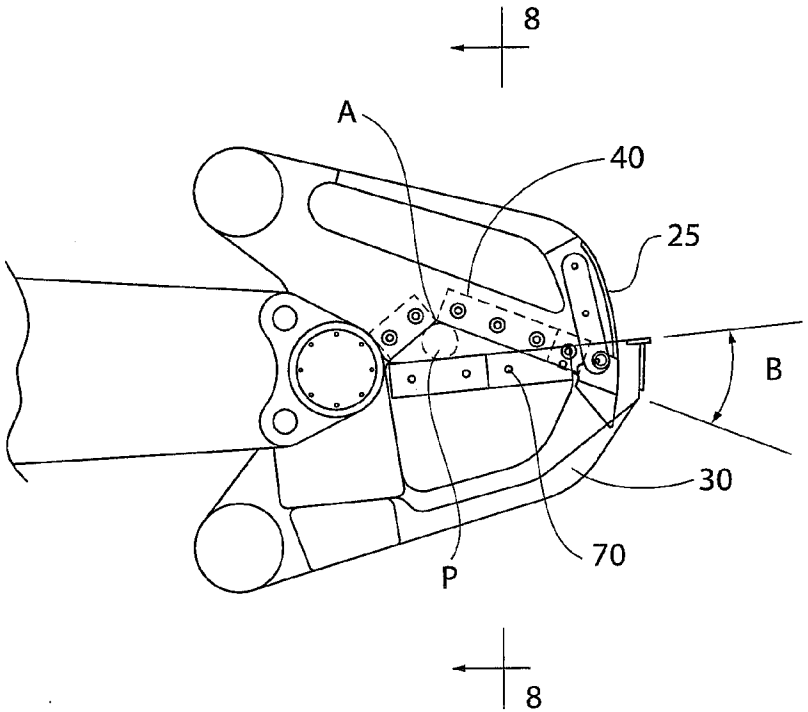
PRIOR ART FIG. 2
FIG. 2 is the shear attachment illustrated in FIG. 1 with the jaws moving towards the closed position.
Figure 7:
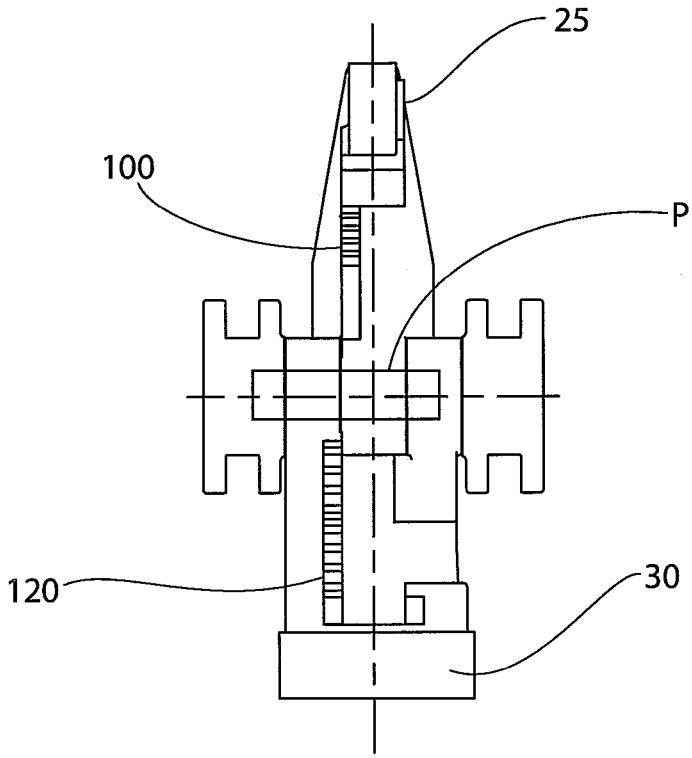
FIG. 7 is an end view of a jaw set in the open position.
Figure 8:
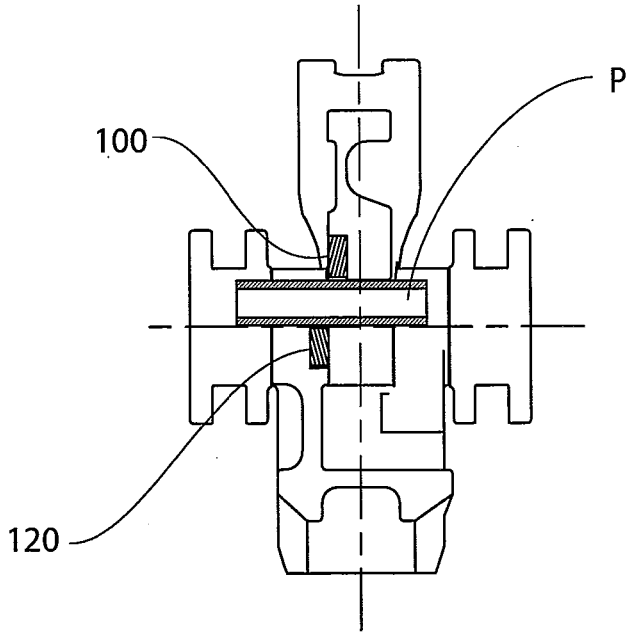
FIG. 8 is an end view of a jaw set approaching the closed position.

FIG. 7 and FIG. 8 are schematic cutaway views along lines 7-7 in FIG. 1 and lines 8-8 in FIG. 2, respectively. FIG. 7 illustrates the small diameter pipe P in position with the first jaw 25 and the second jaw 30 opened. FIG. 8, on the other hand, illustrates the small diameter pipe P after contact is made by the blade insert 100 and the blade insert 120 to begin the cutting operation. It should be appreciated that there is very little lateral distance between the blade insert 100 and the blade insert 120 to maximize the shear imparted to the workpiece, such as pipe P.

Figure 9:
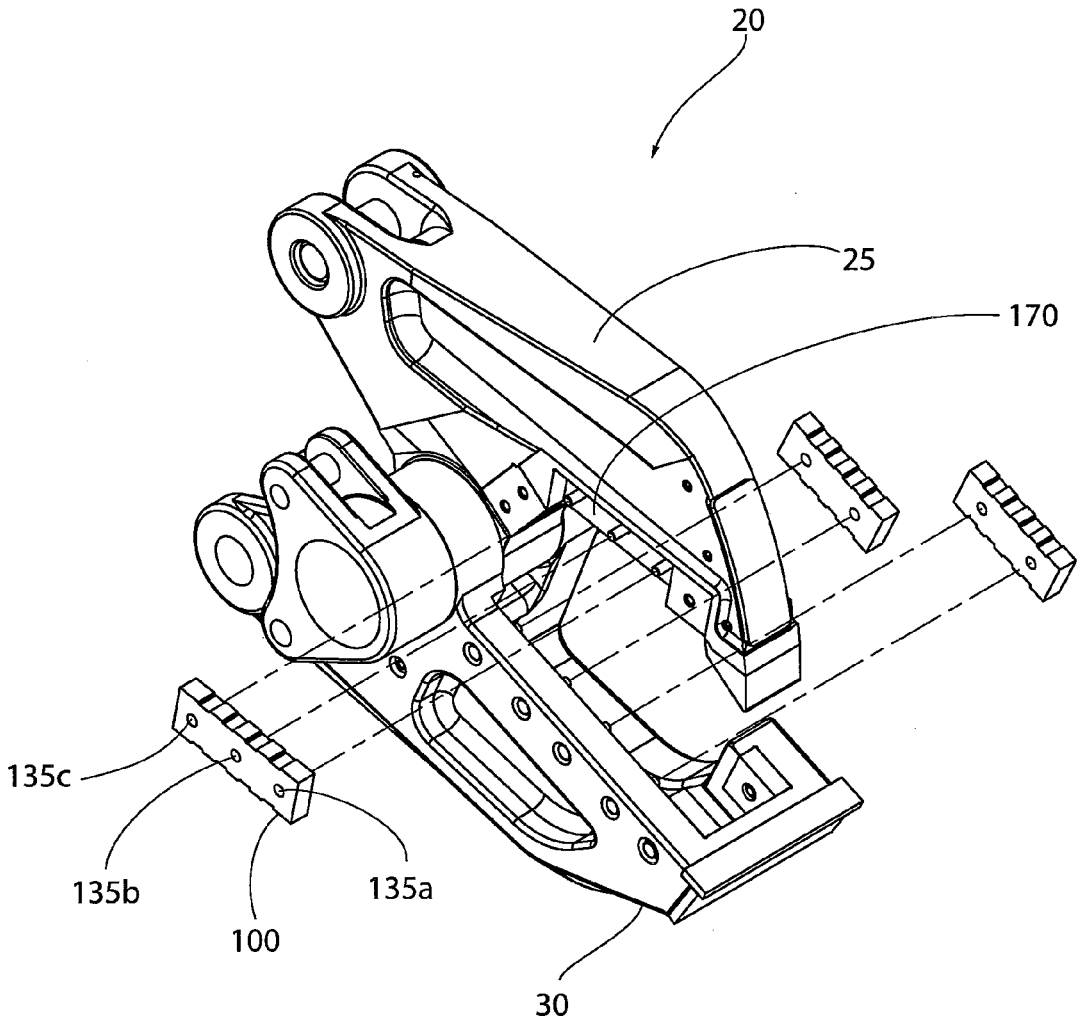
FIG. 9 is a perspective view of the subject invention with the blade inserts illustrated in an exploded position.
Figure 10:
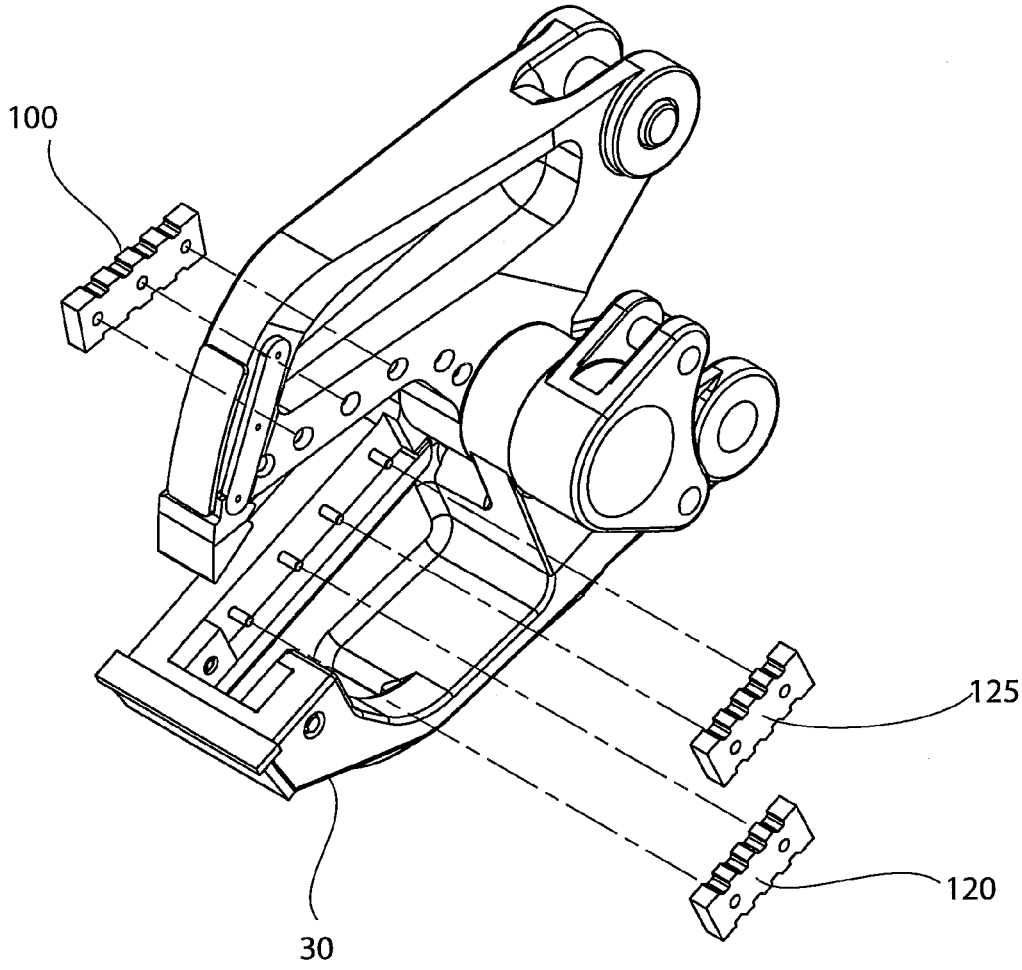
FIG. 10 is a perspective view from another direction of the jaw set illustrated in FIG. 9.

Directing attention to FIGS. 9 and 10, it should be noted that each blade insert 100, for example, fits within a recessed area 170 of the first jaw 25 and is secured therein with bolts (not shown) extending through the bolt holes 135*a*, 135*b*, 135*c* and secured to the first jaw 25. Each of the blade inserts, such as blade inserts 120, 125, is secured in a similar fashion. It should also be noted that the jaw 25 and the jaw 30 are commercially available and, as a result, all that is required to upgrade the jaw set 20 to significantly improve performance in cutting small diameter pipe and wire cable is to replace blade inserts with the serrated blade inserts disclosed herein.

It should also be apparent from inspection of FIG. 9 and FIG. 10 that the blade insert 100 associated with the first jaw 25 is within a recessed area and that the blade inserts 120 and 125 associated with the second jaw 30 are located in another recessed area 175 in opposing relationship with the recessed area 170 of the first jaw 25.

It has been found that the serrated blade inserts of the subject invention cut 80-90% longer than the traditional smooth blades before requiring blade rotation to a new edge. This benefit does not factor in the further extended blade life that can be achieved by sharpening and shimming.

An added benefit of the serrated blade inserts occurs during the cutting operation, wherein the blade inserts progressively saw through the wire cable in the same fashion as a hack saw blade cuts, rather than trying to sever the cable, like chopping at something with a dull axe. While the sharp shear blade edge of the cutting insert does cut the cable, the cutting action is further implemented because the serrated blade insert utilizes a tearing or shredding action rather than complete shearing or snipping. Additionally, serrated blades weaken the structural integrity of wire cable by unraveling it, while simultaneously shredding the strands, which enable the blades to cut the cable with far less effort, thus minimizing overall wear and tear to the blades and all of the other shear components.

When cutting small diameter pipe, the smooth, traditional blade inserts gather and bunch the material, forcing the jaw to cut a mass of material all at once in the region of the apex. In contrast, utilizing the serrated blade inserts, smaller diameter material is trapped at various notches along each of the blades, sequentially spreading out the strands of the cable, thus using a fraction of the energy to cut the same material volume, resulting in longer blade life, less stress on the blade bolts, and overall lower maintenance.

The invention claimed is:

1. A jaw set for demolition equipment, wherein the jaw set is made up of a first jaw and a second jaw and, wherein at least one jaw rotates relative to the other jaw about a rotational axis, the jaw set comprising:

a) a first jaw blade extending from a front end of the first jaw to a back end of the first jaw proximate to the rotational axis, wherein the first jaw blade has a front section and a rear section forming an obtuse angle relative to the front section defining an apex therebetween;

i) at least one blade insert secured to each of the front section and the rear section of the first blade, wherein each blade insert has a longitudinal axis extending along the length of each insert;

ii) wherein at least one blade insert of the front section has a cutting surface with grooves spaced along the longitudinal axis to provide a serrated cutting surface;

b) a second jaw blade extending from a front end of the second jaw to a back end of the second jaw proximate to the rotational axis;

i) at least one blade insert secured to a section of the second blade, wherein each blade insert has a longitudinal axis extending along the length of each insert; and ii) wherein at least one blade insert of the section has a cutting surface with grooves spaced along the longitudinal axis to provide a serrated cutting surface;

c) wherein the first jaw blade and the second jaw blade rotate relative to one another to function as a shear; and d) wherein in a closed position, the cutting surface of the blade insert of the front section of the first jaw overlaps with and forms an acute angle with the cutting surface of the blade insert of the section of the second jaw blade.

2. The jaw set according to claim 1, wherein planar segments are interspaced between the grooves.

3. The jaw set according to claim 2, wherein each blade insert has bolt holes extending therethrough perpendicular to and along the length of the longitudinal axis and parallel to the planar segments, wherein the bolt holes are longitudinally spaced from each groove to provide maximum blade strength.

4. The jaw set according to claim 1, wherein the grooves are oriented perpendicular to the longitudinal axis.

5. The jaw set according to claim 1, wherein each blade insert has a width and grooves extend across the width of each blade insert.

6. The jaw set according to claim 1, wherein the length of the planar section between each groove is equal to or greater than the length of the groove.

7. The jaw set according to claim 1, wherein when two blade inserts are abutting with one another, the combined length of the planar sections of the abutting blade inserts is equal to or greater than the length of the groove.

8. The jaw set according to claim 1, wherein blade inserts without grooves are positioned at the front end of each of the first jaw blade and the second jaw blade.

9. The jaw set according to claim 1, wherein a blade insert without grooves is positioned at the rear section of the first jaw blade.

10. The jaw set according to claim 1, wherein for each blade insert, the groove has a length of ½ inch and a depth of ¼ inch.

11. The jaw set according to claim 1, wherein for each blade insert, the groove length is at least twice the depth of the groove depth.

12. The jaw set according to claim 1, wherein the grooves are generally U-shaped and are radiused at the corners of the base.

13. The jaw set according to claim 1, wherein the grooves intersect with the planar section at a sharp corner.

14. The jaw set according to claim 1, wherein the length of the planar sections may vary to locate the bolt holes away from the grooves.

15. The jaw set according to claim 1, wherein each blade insert has a top side and a bottom side with cutting surfaces including grooves and planar sections on both the top side and the bottom side such that the blade inserts may be indexable.

* * * * *